United States Patent [19]

Endo et al.

[11] Patent Number: 4,694,993

[45] Date of Patent: Sep. 22, 1987

[54] CRUSHING AND WASHING PROCESSING APPARTUS FOR BALLAST AND SAND

[76] Inventors: Shigeharu Endo; Kazuma Endo, both of 22-3, Motoshiro-cho, Fujinomiya-shi, Shizuoka-ken, Japan

[21] Appl. No.: 782,288

[22] Filed: Sep. 30, 1985

[51] Int. Cl.[4] ..... B02C 19/22

[52] U.S. Cl. ..... 241/46.11; 241/69; 241/152 A; 241/163; 241/260.1; 241/261.1

[58] Field of Search ..... 241/46.17, 46.11, 46.06, 241/70, 46.02, 284, 260.1, 101.2, DIG. 10, 152 A, 261.1, 247, 188 R, 62, 43, 45, 163, 69

[56] References Cited

U.S. PATENT DOCUMENTS 3,522,934 8/1970 Walter ..... 241/62

4,108,385 8/1978 Funk ..... 241/46.17 X 4,249,703 2/1981 Korenev et al. ..... 241/247

*Primary Examiner*—Mark Rosenbaum

*Attorney, Agent, or Firm*—McAulay, Fields, Fisher, Goldstein & Nissen

[57] ABSTRACT

A crushing and washing apparatus for ballast and sand having a cylinder barrel on a base member, the barrel being formed at its one end with a feed port, at its other end with a discharge port, and therebetween with a water filling port, a sleeve fitted onto a rotary shaft extending near to the discharge port of the barrel being arranged thereon with agitating wings, the discharge port of the barrel being reciprocally movaly fitted with a rotary crushing bowl, and a marginal portion of the barrel near to the discharge port being provided with a mounting section of the perforated cover including a plurality of discharge holes.

5 Claims, 6 Drawing Figures

CRUSHING AND WASHING PROCESSING APPARTUS FOR BALLAST AND SAND

BACKGROUND OF THE INVENTION

This invention relates to a crushing and washing processing apparatus for ballast and sand gathered from mountains, lands, etc.

Since a lot of viscous mud, soft stones, and the like are mixed in ballast and sand gathered from mountains and lands, etc., it is a usual practice to wash them several times by water. However, this water washing is not enough to completely remove the mud attached to the ballast and sand. This decreases the value of the product as an aggregate for concrete.

In recent years, a ballast crushing and washing processing apparatus has been proposed in order to remove mud attached to the surface of such ballast so that they can be satisfactorily used as a concrete aggregate. However, in this known apparatus, in order to place the ballast in a state that can be used as the concrete aggregate, a comparatively long time was required for the crushing and washing processing in its cylindrical barrel. As a result, efficiency was decreased. Moreover, since a comparatively long cylindrical barrel was required, the size of the apparatus became large. In addition, this conventional apparatus had a disadvantage as the crushing and washing processing could only be used for ballast but not for sand.

SUMMARY OF THE INVENTION

The object of the present invention is to provide a crushing and washing apparatus for ballast and sand which can perform the crushing and washing processing not only for ballast but also for sand, which is simple in its construction, and which can process the ballast and sand in a comparatively short time and with excellent efficiency.

The above-mentioned objects can be achieved by mounting a cylindrical barrel on a base member wherein the cylindrical barrel is formed at its one end with a feed port, at its other end with a discharge port, and therebetween with a water filling port. A rotary shaft extending to the vicinity of the discharge port of the cylindrical barrel is fitted with a sleeve including agitating wings. The discharge port of the cylindrical barrel is fitted with a rotary crushing bowl to be reciprocally movable, and the cylindrical barrel is provided at its marginal portion near the discharge port with a mounting mechanism for a perforated cover having a plurality of discharge holes.

In the present invention, in order to perform crushing and washing processing not only for ballast but also for sand, the cylindrical barrel is provided at its discharge port with a crushing bowl of a rotary type to be reciprocally movable with respect to the discharge port. Provided in an appropriate location in the peripheral portion of the discharge port is a mounting section for mounting a perforated cover formed with a number of discharge holes therein. Moreover, a water filling port is provided at an appropriate location in the peripheral portion of the discharge port. When the crushing and washing processing of the ballast is to be performed, the rotary type crushing bowl is mounted on the discharge port so that soft stones contained in the ballast will be crushed to fine pieces by the crushing bowl and agitating wings and at the same time, the mud attached to the ballast will be rubbed and washed away with water fed from the water filling port. Similarly, when the crushing and washing processing of the sand is to be performed, the rotary type crushing bowl is moved away from the discharge port and the perforated cover is mounted on the discharge port. Crushing pressure within the cylindrical barrel is increased by this perforated cover so that the soft stones contained in the sand will be crushed. At the same time, the mud is washed away with water fed from the water filling port and only sand of good quality is produced by means of the number of discharge holes formed in the perforated cover.

BRIEF DESCRIPTION OF THE DRAWINGS

The accompanying drawings illustrate embodiments of a crushing and washing processing apparatus for ballast and sand according to the present invention wherein.

DETAILED DESCRIPTION OF THE PREFERRED EMBODIMENTS

Figure 1:
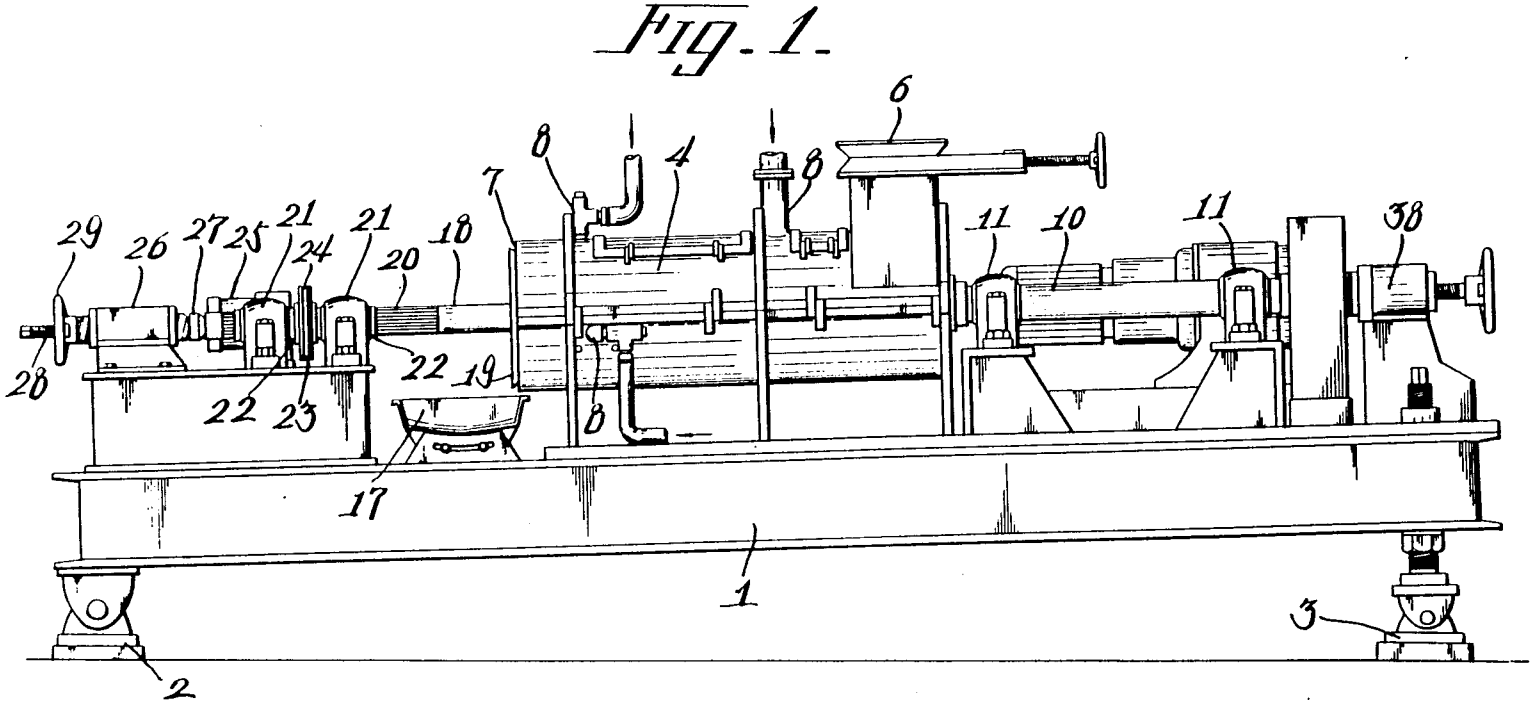
FIG. 1 is its front view.
Figure 2:
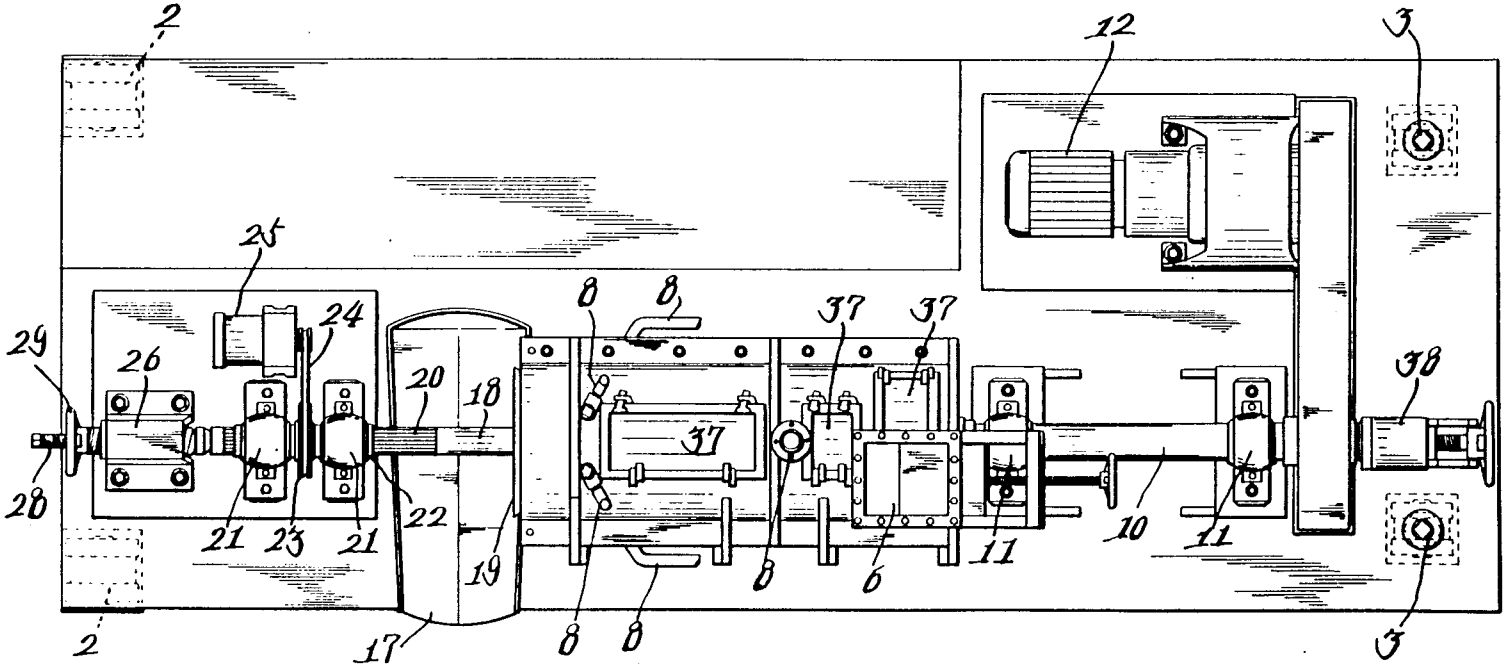
FIG. 2 is its plan view.
Figure 3:
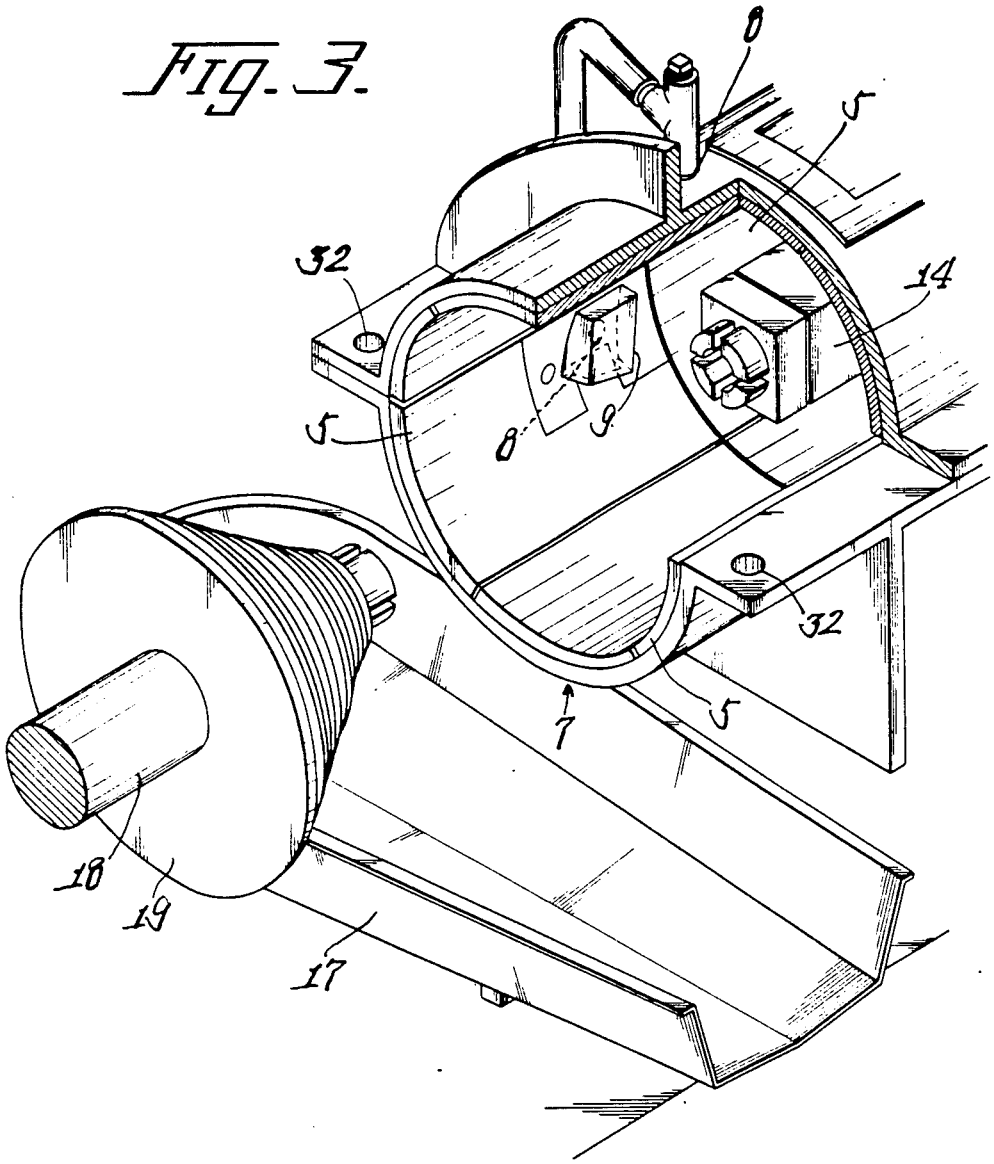
FIG. 3 is a perspective view, partly cut away, of the apparatus which is now used for crushing and washing processing for ballast, when viewed from the discharge port side.
Figure 4:
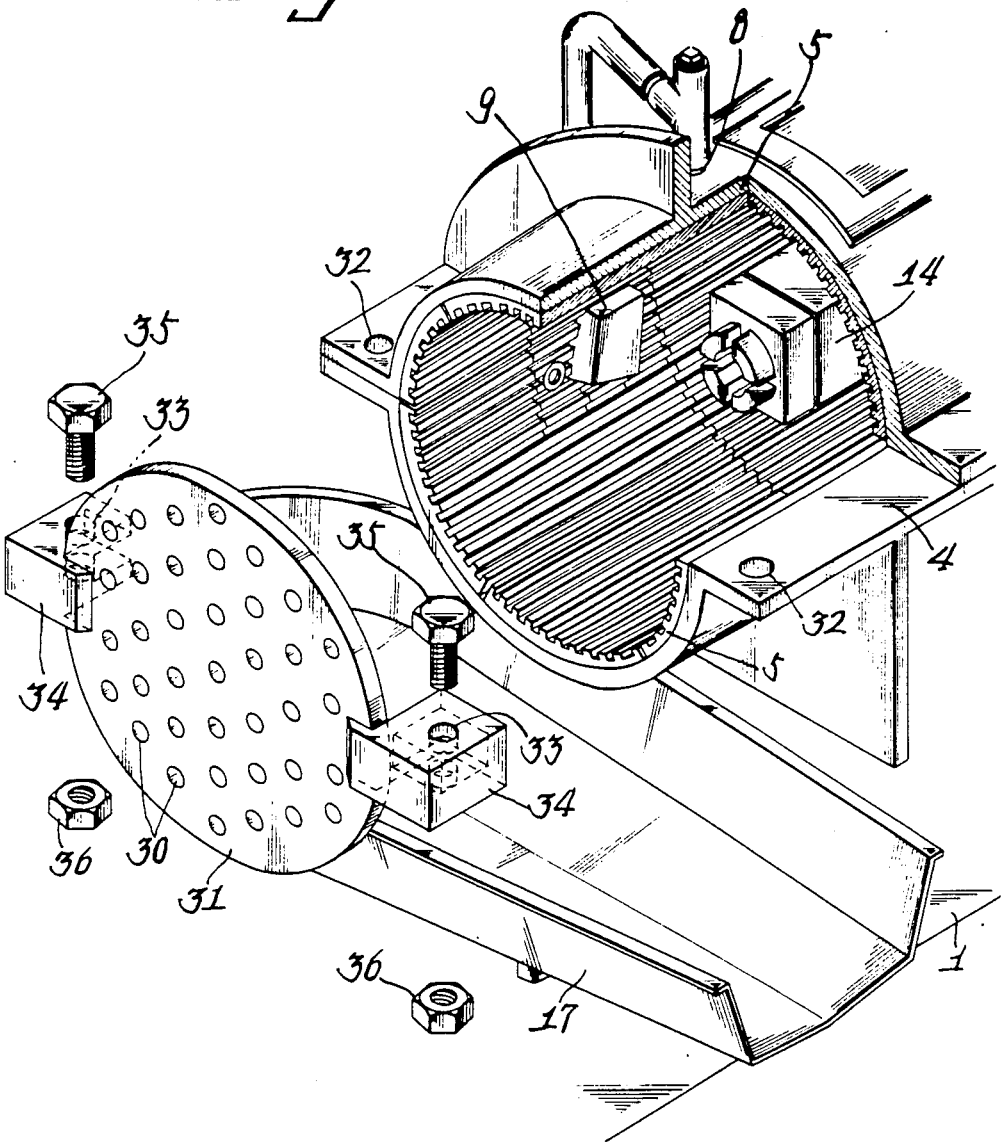
FIG. 4 is a perspective view, partly cut away, of the apparatus which is now used for crushing and washing processing for sand, when viewed from the discharge port.

In the figures, numeral 1 denotes a base member. The base member 1 is mounted at its one end with supporting legs 2 and 2, and at its other end with tilt adjusting supporting legs 3 and 3. The base member 1 is made adjustable and tilts with respect to the axis thereof in its elongated direction. Mounted on the base member 1 is a cylindrical barrel 4. The barrel 4 is provided at its internal wall with a lining 5 formed either with grooves at predetermined spacing with respect to each other, or with a number of projections. The lining 5 is secured tight by a screw means from outside of the barrel 4. The barrel 4 is formed in a double layer and opens at its upper half portion. The barrel 4 is provided in the upper wall of one end with a feed port 6 for feeding ballast and sand therethrough. Also, the barrel 4 is provided with water filling ports at the front of the feed port 6, in the upper half in the vicinity of a discharge port 7 at its other end, and at the lower half on both sides thereof. The water filling ports 8 located at the lower half of the barrel in the vicinity of the discharge port 7 include, as shown in FIGS. 3 and 4, a cover 9 respectively at an internal portion of the barrel 4, so that the ballast and sand will not enter into the port 8.

Figure 5:
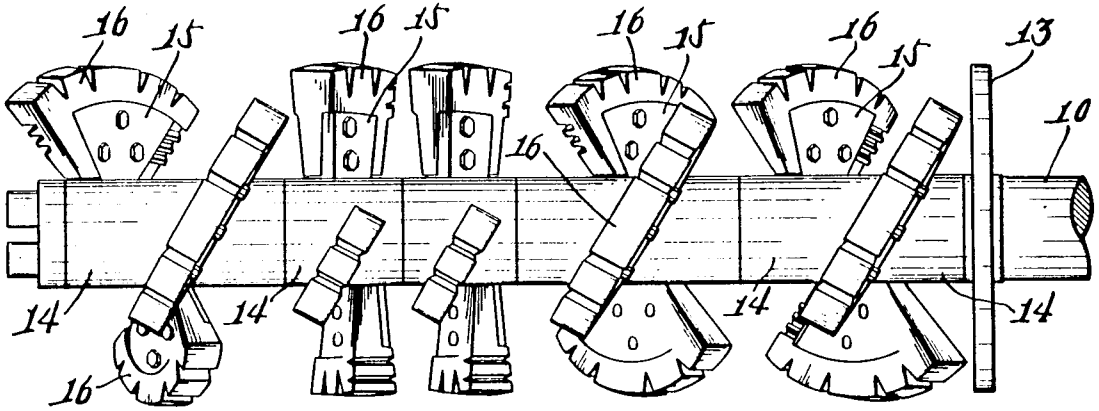
FIG. 5 is a front view showing an arrangement of agitating wings for performing crushing and washing processing for ballast.
Figure 6:
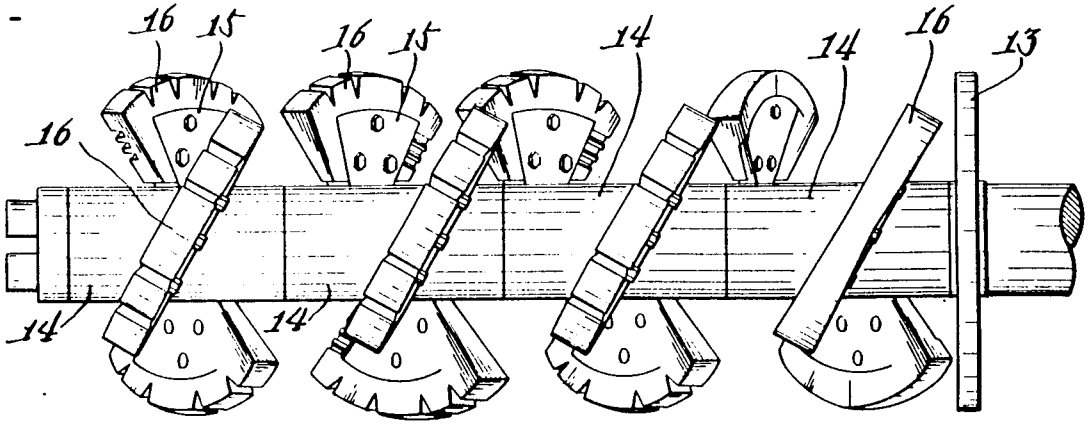
FIG. 6 is a plan view showing an arrangement of the agitating wings for performing crushing and washing processing for sand.

Disposed in its center through its one end of the cylindrical barrel 4 is a rotary shaft 10 of a square column shape. The rotary shaft 10 is carried at its one end by spaced bearings 11 positioned on the external base member 1 of the barrel 4. At the same time, the one end of the rotary shaft 10 is connected to a driving motor 12 containing a reduction mechanism therein. The other end of the rotary shaft 10 terminates near the discharge port 7 of the barrel 4. Hached to the rotary shaft 10 is a shielding plate 13 and is positioned at the end portion of the barrel 4. The shielding platte 13 is updated to prevent the ballast and sand fed into the feed port 6 from flowing out to the bearing 11 side. The rotary shaft 10 disposed within the barrel 4 is fitted thereon with a sleeve 14 of a square solumn shape. The sleeve 14, as shown in FIGS. 5 and 6, is provided with mounting plates 15 projecting therefrom. The plates 15 may either be oriented so that they form a spiral or they may lie along the same circumferential line. Each of the mounting plates 15 supports an agitating wing 16 by a screw means.

Arrangement of the agitating wings 16 is different for crushing as opposed to washing processing for ballast, and crushing and washing processing for sand, so that effective crushing can be performed, respectively. For example, in the case of ballast, as shown in FIG. 5, the spiral shaped agitating wings 16 are arranged at the both ends of the rotary shaft 10 and the agitating wings 16 on the same circumferential line are arranged therebetween. In the case of sand, as shown in FIG. 6, the rotary shaft 10 is arranged only at its tip end with the shaped agitating wings 16 lying on the same circumferential line, and at the remaining portions with the spiral shaped agitating wings 16. The base member 1 supports a discharge chute 17 in a location corresponding to the discharge port 7 of the barrel 4. The discharge port 7 of the barrel 4 is fitted with a rotary crushing bowl 19 mounted on the tip portion of the rotary shaft 18. A spline tooth 20 formed on the external surface of the rotary shaft 18 meshes with the tooth formed on the internal surface of a collar 22 of a bearing 21, so that the rotary shaft 18 of the curshing bowl 19 is slidably carried by the bearing 21. At the same time, the rotary shaft 18 is positioned opposite to the rotary shaft 10 and in alignment therewith. A pulley 23 is mounted on the rotary shaft 18 and is positioned between the bearings 21 and 21. The pulley is connected to a low speed motor 25 through a belt 24.

The rotary shaft 18 is provided at its rear portion with a pressuring apparatus 26 adapted to urge the crushing bowl 19 against the discharge port 7 of the barrel 4 through the rotary shaft 18. The pressuring apparatus 26 is slidably fitted with a slide rod 28 attached at its tip portion with a rotary top 27 adjacent to the rear end of the rotary shaft 18. The slide rod 28 is threadedly engaged at its rear end with an adjusting handle 29 adapted to actuate a coil spring positioned within the pressure apparatus 26. By expanding or contracting the coil spring by the adjusting handle 29, the pressing force of the slide rod 28 with respect to the rotary shaft 18 can be adjusted.

As illustrated in FIG. 4, the barrel 4 is formed at its external end portions, or marginal portions in the vicinity of the discharge port 7 with mounting holes 32 adapted to receive bolts 35 to affix in place a perforated cover 31 formed with a number of discharge holes 30. The perforated cover 31 is provided at its both sides with a retaining flange 34 having bolt holes 33. The perforated cover 31 can be detachably attached to the discharge port 7 of the barrel 4 by placing a bolt 35 in the mounting hole 32 and fastening it by a nut 36.

Furthermore, the barrel 4 includes an inspection panel 37 at its upper end so that the crushing process of the ballast and sand can be inspected therethrough. Also, the end portion carried by the bearings 11, 11 includes a thrust pad 38.

The operation of the crushing and washing processing apparatus according to the present invention will be described. When the apparatus of the present invention is used for crushing and washing processing for ballast, as shown in FIG. 5, a sleeve 14 attached with agitating wings 16 that lie along the same circumferential line is arranged on the shaft 10 and sleeves 14 attached with agitating wings 16 in the spiral shape are arranged on both sides of the foregoing sleeve 14. The rotary type crushing bowl 19 is fitted into the discharge port 7 of the cylindrical barrel 4, and at the same time, the rotary shaft 18 is urged at its rear end by the pressuring apparatus 26. The power switches of the low speed motor 25 and the driving motor 12 are turned on for rotating the rotary shafts 10 and 18. Thereafter, while feeding water into the barrel 4 through the respective water filling ports 8, gathered ballast still containing soft stones and mud in fed through the feed port 6 formed on the upper wall of the cylindrical barrel 4. The ballast fed from the feed port 6 is agitated by those agitating wings 16 arranged in the spiral shape and is transferred toward the front. When the ballast arrives at the intermediate agitating wings 16 arranged along the same circumferential line, it stays there for a while and is ground down. This ground ballast is pushed by the succeeding ballast and arrives at the discharge port 7 while being agitated by the agitating wings 16 arranged in the spiral shape at the front. As it reaches the discharge port, the ballast is urged against the lining 5 by the uneven surface of the rotary type crushing bowl 19, which rotates in the reverse direction with respect to the rotary shaft 10 and strongly rubbed with respect to each other. Thus, the soft stones contained in the ballast are completely crushed into fine pieces and washed away together with the mud by water fed from the water filling ports 8 and discharged from the discharge port 7. The ground and cleaned ballast is pushed into the discharge chute 17 through a gap formed between the barrel 4 and the crushing bowl 19. Since the crushing bowl 19 is pushed by pressure of the succeeding ballast which is transferred by the spirally mounted agitating wings 16, the degree of the crushing (or the fineness of the ballast) can be adjusted by properly adjusting the pressure applied to the rotary shaft 18 by turning the adjusting handle 29 of the pressure apparatus 26. This, in effect, adjust the staying time of the ballast within the barrel 4. In this way, a satisfactory crushing and washing state of the ballast can be obtained.

On the other hand, when the apparatus of the present invention is used for crushing and washing processing for sand containing soft stones and mud, the rotary shaft 18 is withdrawn in order to bring the crushing bowl 19 away from the discharge port 7. The lining 5 of the cylindrical barrel 4 is replaced with another lining 5 having uneven surface as shown in FIG. 4. The discharge port 7 is fitted with the perforated cover 31 in place of the crushing bowl 19. At the same time, as shown in FIG. 6, only one sleeve 14 arranged thereon with the agitating wings 16 that lie along the same circumferential line is mounted on the tip portion of the rotary shaft 10. Sleeve 14, with agitating wings 16 arranged thereon in a spiral shape, are positioned from this first sleeve to the shielding plate 13. Thereafter, the power switch of the driving motor 12 is turned on to rotate the rotary shaft 10. The gathered sand is fed through the feed port 6, while water is being supplied from the water filling port 8. The sand is transferred toward the discharge port 7 while being agitated by the agitating wings 16 arranged in a spiral shape. Soft stones contained in the sand are strongly agitated by the agitating wings 16 mounted on the tip sleeve and crushed into fine pieces. Mud contained in the sand flows out through the discharge port 30 of the discharge cover 31 together with water. High quality sand produced by the crushing and washing processing in the foregoing manner is urged against the perforated cover 31 by the pressure of the succeeding sand transferred by the agitating wings 16, and forced out into the discharge chute 17. Crushing effect of the soft stones contained in the sand can be properly controlled by selecting a proper perforated cover 31 out of several perforated covers 31 having different discharge holes 30. A satisfactory crushing effect can be obtained by adjusting the staying time of the sane in the barrel 4 by changing the required discharging pressure which is determined by the discharge holes 30 for sand.

As apparent from the foregoing description, according to the present invention, a provision of a crushing bowl of a rotary type at a discharge port serves to increase the crushing effect. At the same time, processing speed can be improved extensively. Also, by providing water filling ports at the periphery of the discharge port, viscous mud can swiftly flow out, thus eliminating crushing loss due to the viscous mud. Moreover, since a perforated cover can be used in the place of the crushing bowl, the present apparatus can perform crushing and washing processing not only for ballast but also for sand. As a consequence, even if the apparatus is not large, crushing and washing processing for ballast and sand can be easily performed. In addition, since the cylindrical barrel can be opened, not only the replacement of the agitating wings and lining can be made easily but also the crushing effect can be improved tremendously by replacing the lining with others.

What is claimed is:

1. A crushing and washing apparatus for ballast and sand comprising:

a cylindrical barrel formed at one end with a feed port for the introduction of ballast and sand, and at the other end with a discharge port;

at least one water filling port between said feed and discharge ports;

a rotary shaft within said barrel extending from said feed port to a point adjacent said discharge port;

at least a sleeve having agitating wings thereon mounted on said rotary shaft; and back pressure control means connected with said discharge port for selectively varying the back pressure applied to the ballast and sand to control the amount of time the ballast and sand are subjected to said agitating wings, said back pressure control means comprising a rotary crushing bowl longitudinally movable into and out of said discharge port;

and a rotary shaft supporting said crushing bowl, a bearing slideably supporting said shaft, and pressure means adjacent the end of said shaft for applying a preselected pressure to the end of said shaft.

2. An apparatus as in claim 1, and a lining having a number of projections therein detachably connected to the inner surface of said cylindrical barrel.

3. An apparatus as in claim 1, and a lining having a plurality of spaced grooves detachably connected to the inner surface of said barrel.

4. An apparatus as in claim 1, in which said barrel comprises an upper half and a lower half, and means connecting said upper half to said lower half to permit opening of said upper half to gain access to the interior of said barrel.

5. Apparatus as in claim 1, in which said crushing bowl is rotated in a direction opposite to the direction of said rotary shaft.

* * * * *